US008161878B2

(12) United States Patent
Schellhorn et al.

(10) Patent No.: US 8,161,878 B2
(45) Date of Patent: Apr. 24, 2012

(54) SAFETY AND ARMING UNIT FOR A PROJECTILE

(75) Inventors: Andreas Schellhorn, Schramberg (DE); Frank Martin Kienzler, Villingen-Schwenningen (DE); Martin Leonhardt, Aichhalden (DE)

(73) Assignee: Junghans Microtec GmbH, Dunningen-Seedorf/BRD (DE)

( * ) Notice: Subject to any disclaimer, the term of this patent is extended or adjusted under 35 U.S.C. 154(b) by 233 days.

(21) Appl. No.: 12/621,694

(22) Filed: Nov. 19, 2009

(65) Prior Publication Data

US 2010/0326307 A1 Dec. 30, 2010

(30) Foreign Application Priority Data

Jun. 27, 2009 (DE) ..... 20 2009 008 861 U

(51) Int. Cl.
*F42C 15/34* (2006.01)

(52) U.S. Cl. ..... 102/254; 102/226; 102/202.1; 102/222

(58) Field of Classification Search ..... 102/202.1, 102/222, 226, 229, 235, 244, 245, 251, 254–256
See application file for complete search history.

(56) References Cited

U.S. PATENT DOCUMENTS

| | | | | |
|---|---|---|---|---|
| 4,876,960 | A * | 10/1989 | Schillinger et al. | 102/249 |
| 5,693,906 | A * | 12/1997 | Van Sloun | 102/251 |
| 7,296,504 | B2 * | 11/2007 | Borg et al. | 89/1.14 |
| 7,464,648 | B2 * | 12/2008 | Teowee et al. | 102/254 |
| 7,661,364 | B2 * | 2/2010 | Zinell et al. | 102/237 |
| 7,798,064 | B1 * | 9/2010 | Taylor | 102/251 |
| 2005/0081732 | A1 * | 4/2005 | Worthington | 102/229 |
| 2008/0238058 | A1 * | 10/2008 | Numoto et al. | 280/737 |
| 2011/0056401 | A1 * | 3/2011 | Aliaghai et al. | 102/251 |
| 2011/0203474 | A1 * | 8/2011 | Westphal et al. | 102/256 |

* cited by examiner

*Primary Examiner* — Michael Carone
*Assistant Examiner* — Samir Abdosh
(74) *Attorney, Agent, or Firm* — Lawrence A. Greenberg; Werner H. Stemer; Ralph E. Locher

(57) ABSTRACT

A safety and arming unit for a fuze of a projectile has a rotor for interruption of a firing chain. The rotor can rotate from a safe position to an armed position. In order to allow the safety and arming unit to be designed to be physically compact and such that it can be assembled easily, it is proposed that it has a first and a second rotor safety device which each engage in the rotor in order to block rotor rotation to the armed position, wherein the first rotor safety device is designed to carry out a release movement by virtue of its inertia during a launch acceleration of the projectile, and the second rotor safety device has a pyrotechnic charge for producing a release movement.

13 Claims, 3 Drawing Sheets

SAFETY AND ARMING UNIT FOR A PROJECTILE

CROSS-REFERENCE TO RELATED APPLICATION

This application claims the priority, under 35 U.S.C. §119, of German patent application DE 20 2009 008 861.8, filed Jun. 27, 2009; the prior application is herewith incorporated by reference in its entirety.

BACKGROUND OF THE INVENTION

Field of the Invention

The invention relates to a safety and arming unit for a fuze of a projectile. The unit has a rotor for the interruption of a firing chain. The rotor can rotate from a safe position to an armed position.

Projectiles, such as artillery projectiles, mortar shells or direct projectiles, normally have a fuze with a firing chain which, in its armed position, has two or more firing charges that are arranged one behind the other. The last of these firing charges directs its firing energy at a main charge, which is arranged in the projectile body of the projectile, in order to transmit firing energy to fire the main charge.

A safety and arming unit for a fuze is used to prevent inadvertent activation of the main charge, whereas, however, the activation of the main charge is intended to be possible after arming. For reliable interruption of the firing chain, safety and arming units are known having a rotor which, in its safe position, ensures that the firing chain charge is not aligned with a further charge, or the firing chain is blocked by a mechanical barrier, thus reliably preventing the firing process to proceed from one firing charge to the next.

SUMMARY OF THE INVENTION

It is accordingly an object of the invention to provide a safety for a projectile which overcome the above-mentioned disadvantages of the heretofore-known devices and methods of this general type and which provides for a safety and arming unit for a fuze that can be produced to be compact and ensures a high level of safety against inadvertent firing of the main charge.

With the foregoing and other objects in view there is provided, in accordance with the invention, a safety and arming unit for a fuze of a projectile having a firing chain, comprising:

a rotor for interruption of the firing chain, said rotor being rotatably disposed for rotation from a safe position to an armed position;

a first rotor safety device and a second rotor safety device each disposed to engage in said rotor in order to block a rotation of said rotor into the armed position;

said first rotor safety device being configured to carry out a release movement by virtue of an inertia thereof during a launch acceleration of the projectile; and said second rotor safety device including a pyrotechnic charge for effecting a release movement.

In other words, the objects of the invention are achieved by a safety and arming unit of the type mentioned initially which, further, has a first and a second rotor safety device which each engage in the rotor in order to block rotor rotation to the armed position, wherein the first rotor safety device is designed to carry out a release movement by virtue of its inertia during an acceleration, and the second rotor safety device has a charge for producing a release movement. Two separate safety parameters can be used to unlock the rotor, and are dependent on different physical characteristics. The use of a charge to produce the release movement for the second rotor safety device makes it possible to design the second rotor safety device to be compact. The charge can be fired electronically, for example with the aid of a sensor which measures a physical parameter, for example a spin, a wind speed, a pressure difference, a temperature or the like.

In one advantageous embodiment to the invention, the two release movements take place in a first and a second release direction, wherein the release directions are parallel to one another. The parallelity allows channels, in which safety elements of the rotor safety devices are provided, which each carry out the release movement, to be installed in a parallel direction, thus allowing the elements of the safety and arming unit to be fitted in one direction. This allows the safety and arming unit to be assembled easily, counteracting the probability of assembly errors occurring. Furthermore, the safety and arming unit can be designed to be very compact, by the release movements and release channels being parallel. The parallelity of the release directions includes them being parallel but opposite.

The two release directions are expediently in opposite directions to one another. This makes it possible to prevent the acceleration which produces the first release movement from leading to an undesirable release movement of the second rotor safety device as well. The acceleration therefore actually acts against the second release movement, thus allowing the safety and arming unit to be designed to be particularly reliable.

One advantageous refinement of the invention provides that the first rotor safety device has at least three safety elements which each have a safe position and an armed position and are designed to move in a chain reaction from their safe position to their armed position. By way of example, a chain reaction occurs when the respective next safety element does not start its release movement until the respectively previous safety element has reached its release position. Cascaded arming such as this allows a long arming time to be achieved by purely mechanical elements and without a clock, as a result of which the rotor is held reliably in its safe position for a long time. This makes it possible to ensure a high degree of short-range safety.

The first safety element expediently blocks the second safety element in its safe position, and the second safety element expediently blocks the third safety element in its safe position. This makes it possible to reliably avoid faulty initiation of the third and final safety element.

It is also advantageous for all three safety elements to be armed by a movement in the first release direction. A release movement such as this in one direction allows the first rotor safety device to be designed to be particularly compact.

A further advantageous variant of the invention provides that the second rotor safety device has a safety element which, when in its safe position, engages in a first opening in the rotor, blocking the rotor, and is moved further into the rotor for release. This means that there is no need for the safety element to be moved out of the rotor in a mechanically complex manner. Furthermore, it is possible to ensure that the rotor stays blocked still by the safety element if the charge is fired inadvertently. The first opening is expediently a depression or recess in the rotor.

Advantageously, a second and a third opening open into the first opening, wherein the second opening is shorter than the third opening and is aligned with the safety element when the rotor is in the safe position, such that this safety element is inserted into the second opening in the event of inadvertent, premature ignition of the second rotor safety device and projects beyond the rotor through the shorter length of the second opening, and thus keeps the rotor blocked. This makes it possible to reliably prevent inadvertent premature unlocking of the rotor.

The third opening is expediently intended to hold the safety element such that the rotor is released for movement to the armed position. For this purpose, the safety element can be completely surrounded by the rotor, such that it does not project out of the rotor in any direction.

In order to keep the safety element reliably in the second or third opening after firing of the charge of the second rotor safety device, the safety element and the second and/or the third opening are designed such that the safety element is seated with an interference fit in the second and/or third opening respectively. This therefore reliably prevents the safety element from sliding out of the second or third opening inadvertently. An interference fit can be achieved particularly reliably by means of at least one conical section, which is incorporated on the safety element or at least in the third opening, such that the conical section creates the inference fit when the safety element is fired into the opening.

Other features which are considered as characteristic for the invention are set forth in the appended claims.

Although the invention is illustrated and described herein as embodied in a safety and arming unit for a projectile, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
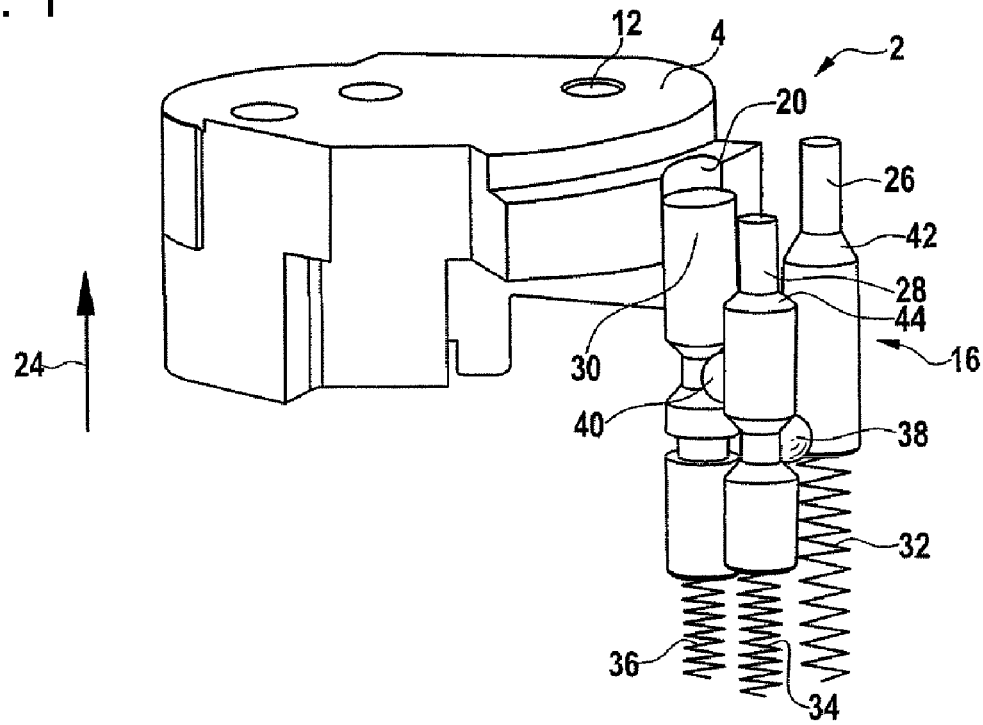
FIG. 1 is a perspective view, obliquely from above, of a safety and arming unit for a fuze of a projectile, having a rotor and a triple bolt system as the first rotor safety device, in the safe position.
Figure 2:
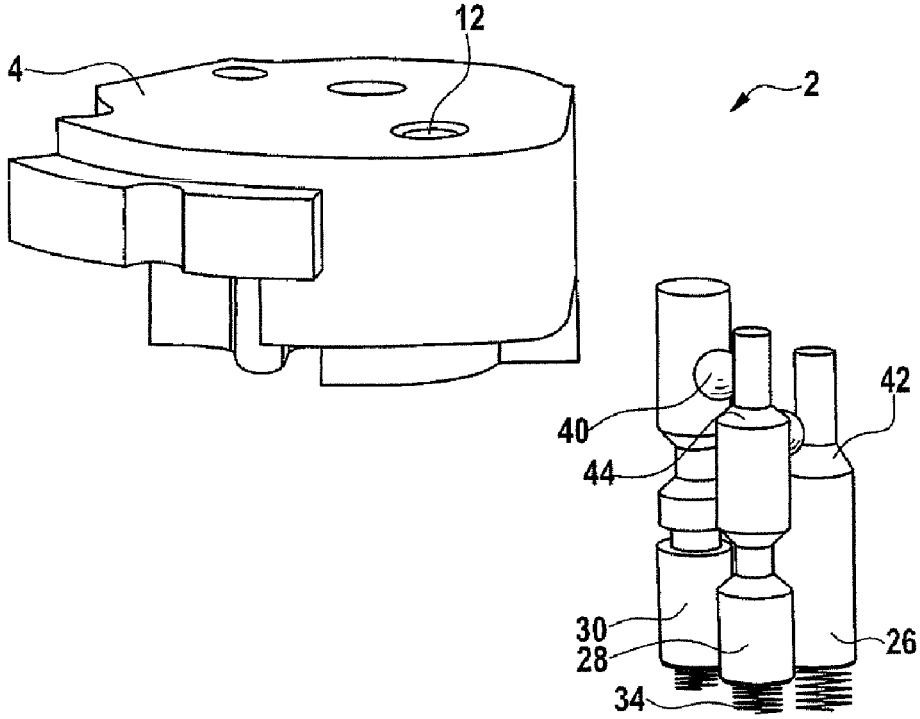
FIG. 2 is a similar perspective view showing the triple bolt system and the rotor in its armed position.
Figure 3:
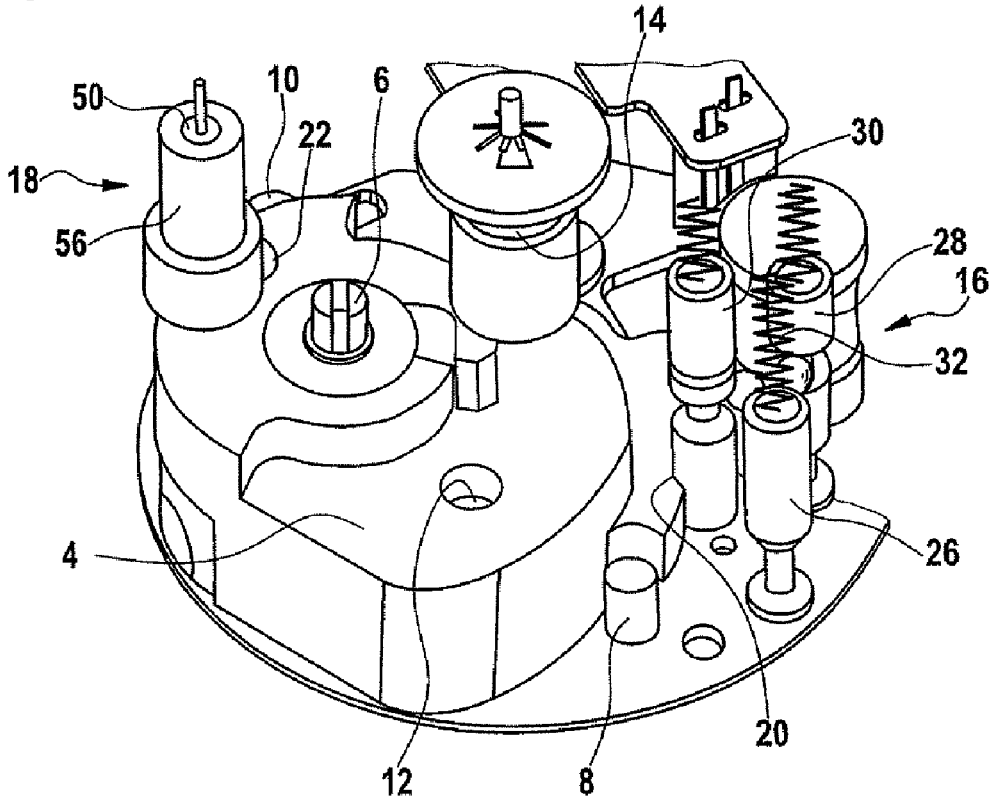
FIG. 3 is a perspective view, obliquely from below, of the rotor and the triple bolt system.

Referring now to the figures of the drawing in detail and first, particularly, to FIG. 1 thereof, there is shown a safety and arming unit 2 for a fuze of a projectile, in the form of a schematic and perspective illustration obliquely from above. The term above is understood with reference to the direction of the fuze nose or projectile nose. The safety and arming unit 2 has a rotor 4, which is illustrated in its blocking safe position in FIG. 1. FIG. 3 likewise shows the rotor 4 in its safe position, but obliquely from below, while in contrast FIG. 2 shows the rotor 4 in its armed position. The rotor 4 can rotate about a shaft 6, which can be seen in FIG. 3, although its rotation is limited by two stop bolts 8, 10. In its safe position, the rotor 4 rests on the stop bolt 8, while in contrast the stop bolt 10 blocks the rotation of the rotor 4 beyond its armed position.

A stemming charge 12 (i.e., transfer charge) is arranged in the rotor 4 and is moved by a movement of the rotor 4 from the safe position, as shown in FIG. 3, to the armed position, aligned with a firing charge 14, which is fired electrically. In the armed position, the stemming charge 12 is fired by the firing charge 14, and itself fires a booster charge (not illustrated) which, like the firing charge 14, is arranged in a fixed position in the fuze, the stemming charge 12 likewise being arranged so as to be aligned with said booster charge when in the armed position. In the safe position, firing of the firing charge 14 is prevented from being passed to the booster charge by the mechanical block formed by the solid rotor 4, thus interrupting firing of the entire firing chain.

In its safe position, the rotor 4 is held mechanically blocked by two rotor safety devices 16, 18, which engage in a respective recess 20, 22 in the rotor 4. These two interlocks prevent rotation of the rotor 4 about its shaft 6. In this case, the first rotor safety device 16 engages radially from the outside in the rotor 4 while, in contrast, the second rotor safety device 18 engages in the axial direction in the rotor 4, and thus blocks it in its safe position. The axial direction is parallel to a launch direction 24 of the projectile.

The first rotor safety device 16 is in the form of a triple bolt system with three safety elements 26, 28, 30, which are each in the form of a bolt and are mounted such that they can move in the fuze, in the launch direction 24 of the projectile. In this case, a respective spring 32, 34, 36 pushes them to their safe position, as illustrated in FIG. 1 and FIG. 3, and as indicated in FIG. 2, as well.

While the projectile is being launched, the launch acceleration acts on the three safety elements 26, 28, 30 which, by virtue of their inertia, exert a force downwards, in the opposite direction to the launch direction 24. Two balls 38, 40 in corresponding grooves in the safety elements 28, 30 prevent these safety elements 28, 30 from moving downwards, however, that is to say in the opposite direction to the launch direction 24, since these balls 38, 40 cannot move out of the grooves. However, the first safety element 26 can be moved downwards against the force of the spring 32, and is pulled downwards by its inertia in the opposite direction to the launch direction 24, as a result of which the spring 32 is compressed. When a conical section 42 reaches the ball 38, as illustrated in FIG. 2, then the tapered upper part of the safety element 26 creates a sufficient amount of space for the ball 38 so that it can be moved in the direction of the first safety element 26. In this case, the groove in the second safety element 26 is provided at the top with an incline, for example in the form of a conical section, which pushes the ball 38 out of the groove by means of the force of the safety element 28 acting downwards, as a result of which the second safety element 28 is released to carry out its release movement. The second safety element 28 is now moved in the same first release direction as that previously of the safety element 26, downwards against the spring force of the spring 34.

The second safety element 28 is likewise provided with a conical section 44 which, on reaching the ball 40, releases it, as can be seen in FIG. 2. It is pushed out of its groove by the third safety element 30 and now releases the third safety element 30 to carry out its release movement in its release direction, in the opposite direction to the launch direction 24. The third safety element 30, which engages in the recess 20 in the rotor 4, is pushed downwards against the force of the spring 36, as a result of which the safety element 30 is moved out of the recess 20 in the rotor 4, and therefore releases the rotor 4. The rotor 4 can now—for example run by spring force, inertia if the projectile is spinning, or by some other driving element—rotate from its first safe position, which is shown in FIGS. 1 and 3, through about 30° to a second safe position, in order to be blocked there once again.

The cascaded arming process of the three safety elements 26, 28, 30 from their safe position as illustrated in FIG. 1 to the armed position as illustrated in FIG. 2 means that the rotor 4 is not armed immediately after the launch acceleration occurs, but is still held for a while in its safe position, thus achieving a high degree of short-range safety. As a result of the third safety element 30, virtually twice the arming time is required to arm the first rotor safety device 16, as in the case of a known double bolt system.

Figure 4:
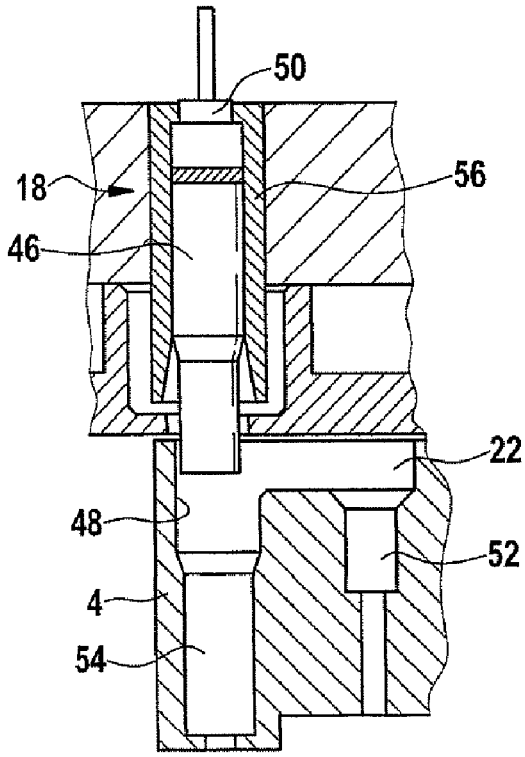
FIG. 4 is a schematic section through a second rotor safety device with a charge and a safety element in its safe position.

After the initial arming of the rotor 4 by the first rotor safety device 16, one safety element 46 of the second rotor safety device 18 is still engaged in the recess 22 in the rotor 4, as illustrated in FIG. 4, and blocks the rotor rotation of the rotor 4 in its armed position. For this purpose, the safety element 46 strikes a stop 48, thus blocking further rotation of the rotor 4. The rotor 4 is now held in its second safe position, in which the rotor 4 blocks the firing chain, and the stemming charge 12 has not yet been arranged aligned with the firing charge 14 and the booster charge.

The safety element 46 is held secured by a sleeve 56, which is mounted in a fixed position in the fuze, that is to say such that it cannot move with respect to an external skin of the fuze, thus stopping rotation of the rotor 4 by the safety element 46.

Figure 5:
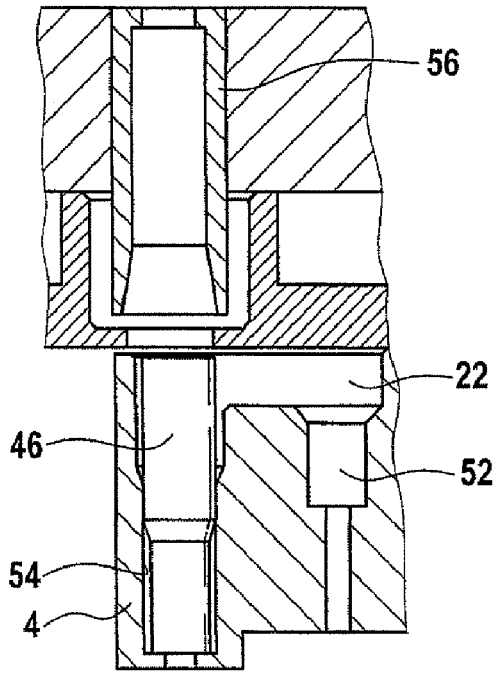
FIG. 5 is a sectional view showing the safety element in its armed position in the rotor.

In addition to the safety element 46, the rotor safety device 18 has a charge 50 which can be fired electrically and encloses the safety element 46 in the rotor 4, to be precise in a first opening 52 or a second opening 54, both of which open into the recess 22. If the rotor 4 has already been released by the first rotor safety device 16, and has been pivoted to its second safe position, as is illustrated in FIG. 4, then the safety element 46 is fired into the second opening 54, and is held completely by the second opening 54 and the recess 22, as is illustrated in FIG. 5, as a result of which the rotor 4 can now rotate to its armed position.

Figure 6:
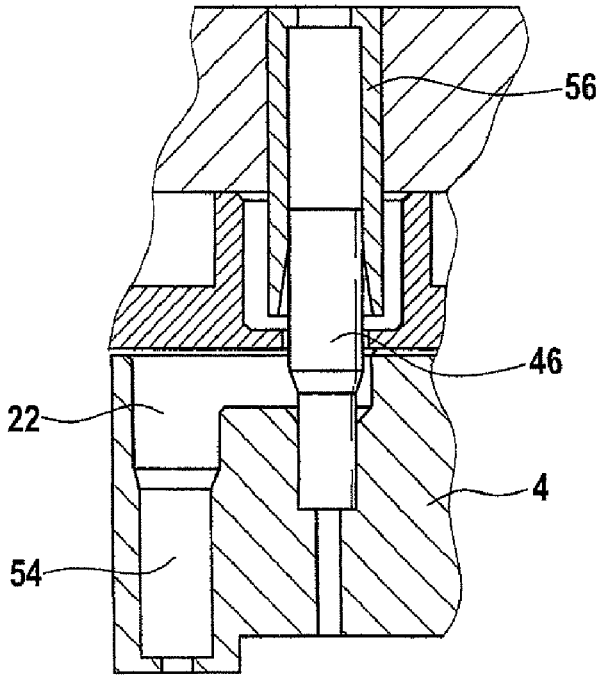
FIG. 6 is a section showing the initiated second rotor safety device with the safety element in a short opening in the rotor, thus blocking the rotation of the rotor.

FIG. 6 shows the rotor 4 in its first safe position, in which the safety element 46 is arranged aligned with the first opening 52. In the event of inadvertent initiation of the charge 50 and the safety element 46 being fired into the rotor 4, the safety element 46 is fired into the opening 52, which is designed to be shorter than the opening 54. The safety element 46 is still held in the sleeve 56, which is mounted such that it cannot rotate, and is now also held in the opening 52, thus blocking rotation of the rotor 4 from the first safe position.

The safety element 46, which has been fired into the first or second opening 52, 54, is seated with an inference fit in the first or second opening 52, 54, into which it is fired by the force of the explosion of the charge 50. In consequence, the safety element 46 is held firmly in the respective opening 52, 54 and cannot fall out again. This prevents inadvertent renewed blocking of the rotor 4 when the safety element 46 is in the second opening 54, and inadvertent release of the rotor 4 to its second safe position when the safety element 46 is in the first opening.

The release movement of the safety element 46 in a second release direction runs parallel to the launch direction 24, but in the opposite direction to it. The powerful acceleration forces during launch of the projectile therefore result, by virtue of the inertia of the safety element 46, in the latter being pressed in the opposite direction to its release direction. This counteracts inadvertent release of the rotor 4 during launch of the projectile.

The invention claimed is:

1. A safety and arming unit for a fuze of a projectile having a firing chain, comprising:

a rotor for interruption of the firing chain, said rotor being rotatably disposed for rotation from a safe position to an armed position;

a first rotor safety device and a second rotor safety device each disposed to engage in said rotor in order to block a rotation of said rotor into the armed position;

said first rotor safety device being configured to carry out a release movement by virtue of an inertia thereof during a launch acceleration of the projectile; and said second rotor safety device including a pyrotechnic charge for effecting a release movement;

wherein the release movement carried out by said first rotor safety device is directed in a first release direction and the release movement effected by said second rotor safety device is directed in a second release direction, and the first and second release directions are parallel to one another.

2. The safety and arming unit according to claim 1, wherein the two release directions are in opposite directions to one another.

3. The safety and arming unit according to claim 1, wherein said first rotor safety device includes at least three safety elements each having a safe position and an armed position and said at least three safety elements are configured to move in a chain reaction from the safe position to the armed position thereof.

4. The safety and arming unit according to claim 3, wherein said first safety element blocks said second safety element in the safe position thereof, and said second safety element blocks said third safety element in the safe position thereof.

5. The safety and arming unit according to claim 4, wherein all of said at least three safety elements are armed by a movement in the first release direction.

6. The safety and arming unit according to claim 3, wherein all of said at least three safety elements are armed by a movement in the first release direction.

7. The safety and arming unit according to claim 1, wherein said second rotor safety device includes a safety element having a safe position, in which said safety element engages in a recess formed in said rotor and blocks the rotor, and a release position wherein said safety element is moved farther into said rotor for release.

8. The safety and arming unit according to claim 7, wherein said rotor is further formed with a first opening and a second opening each opening into said recess, said first opening is shorter than said second opening and is aligned with said safety element when said rotor is in the safe position, whereby said safety element is inserted into said first opening on occasion of an inadvertent, premature ignition of said second rotor safety device and projects beyond said rotor through a length of said first opening and thus keeps said rotor blocked.

9. The safety and arming unit according to claim 8, wherein said second opening is configured to hold said safety element such that said rotor is released for movement to the armed position.

10. The safety and arming unit according to claim 8, wherein said safety element and one or both of said first and second openings are configured such that said safety element is seated with an interference fit in the respective said opening.

11. A safety and arming unit for a fuze of a projectile having a firing chain, comprising:

a rotor for interruption of the firing chain, said rotor being rotatably disposed for rotation from a safe position to an armed position;

a first rotor safety device and a second rotor safety device each disposed to engage in said rotor in order to block a rotation of said rotor into the armed position;

said first rotor safety device being configured to carry out a release movement by virtue of an inertia thereof during a launch acceleration of the projectile; and said second rotor safety device including a pyrotechnic charge for effecting a release movement and including a safety element having a safe position, in which said safety element engages in a recess formed in said rotor and blocks the rotor, and a release position wherein said safety element is moved farther into said rotor for release; and wherein said rotor is further formed with a first opening and a second opening each opening into said recess, said first opening is shorter than said second opening and is aligned with said safety element when said rotor is in the safe position, whereby said safety element is inserted into said first opening on occasion of an inadvertent, premature ignition of said second rotor safety device and projects beyond said rotor through a length of said first opening and thus keeps said rotor blocked.

12. The safety and arming unit according to claim 11, wherein said second opening is configured to hold said safety element such that said rotor is released for movement to the armed position.

13. The safety and arming unit according to claim 11, wherein said safety element and one or both of said first and second openings are configured such that said safety element is seated with an interference fit in the respective said opening.

* * * * *